US011381035B2

(12) United States Patent
Zhu et al.

(10) Patent No.: US 11,381,035 B2
(45) Date of Patent: Jul. 5, 2022

(54) ELECTRICAL CONNECTOR ASSEMBLY

(71) Applicant: FOXCONN INTERCONNECT TECHNOLOGY LIMITED, Grand Cayman (KY)

(72) Inventors: Jian-Kuang Zhu, Kunshan (CN); Xiao-Juan Lin, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 11 days.

(21) Appl. No.: 16/908,629

(22) Filed: Jun. 22, 2020

(65) Prior Publication Data

US 2020/0403355 A1 Dec. 24, 2020

(30) Foreign Application Priority Data

Jun. 21, 2019 (CN) ..... 201920948333.5

(51) Int. Cl.
*H01R 13/627* (2006.01)
*H01R 24/20* (2011.01)
*H01R 12/71* (2011.01)

(52) U.S. Cl.
CPC ..... *H01R 13/6273* (2013.01); *H01R 12/716* (2013.01); *H01R 24/20* (2013.01)

(58) Field of Classification Search
CPC .. H01R 13/6273; H01R 24/20; H01R 12/716; H01R 12/707; H01R 13/6275; H01R 12/79
USPC ..... 439/357
See application file for complete search history.

(56) References Cited

U.S. PATENT DOCUMENTS 5,591,041 A * 1/1997 Cecil, Jr. ..... H01R 13/506 439/352
6,341,972 B1 * 1/2002 Odorfer ..... H01R 13/641 439/352
6,530,799 B2 * 3/2003 Regnier ..... H01R 13/6273 439/352
6,705,886 B1 * 3/2004 Brown ..... H01R 13/641 439/352
6,866,534 B2 * 3/2005 Hirschmann ..... H01R 13/639 439/188
7,108,540 B2 * 9/2006 Annecke ..... H01R 13/6275 439/352
7,121,867 B2 * 10/2006 Annecke ..... H01R 13/6273 439/352
7,131,854 B1 * 11/2006 Pavlovic ..... H01R 13/6273 439/352
7,306,474 B1 * 12/2007 Brown ..... H01R 13/7032 439/352

(Continued)

*Primary Examiner* — Abdullah A Riyami
*Assistant Examiner* — Nelson R. Burgos-Guntin
(74) *Attorney, Agent, or Firm* — Ming Chieh Chang; Wei Te Chung

(57) ABSTRACT

An electrical connector assembly includes a receptacle connector and a plug connector mateable with each other at least in the front-to-back direction. The receptacle connector includes an insulative receptacle housing with a plurality of receptacle contacts therein, and a pair of deflectable metal latches. The plug connector includes an insulative plug housing with a plurality of plug contacts therein, and a pair of immovable metal locking pieces having corresponding locking protrusions to be engaged with the corresponding locking heads of the latches during mating.

20 Claims, 5 Drawing Sheets

(56) References Cited

U.S. PATENT DOCUMENTS

| | | | | |
|---|---|---|---|---|
| 7,344,403 | B2 * | 3/2008 | Major | H01R 13/506 439/352 |
| 7,396,253 | B2 * | 7/2008 | Nakamura | H01R 13/641 439/188 |
| 7,744,432 | B2 * | 6/2010 | Son | F42B 3/04 439/743 |
| 8,968,021 | B1 * | 3/2015 | Kennedy | H01R 13/6271 439/352 |
| 9,017,090 | B2 * | 4/2015 | Matsumoto | H01R 13/635 439/350 |
| 9,039,438 | B2 * | 5/2015 | Gunreben | H01R 13/627 439/352 |
| 9,240,653 | B2 | 1/2016 | Jae | |
| 9,325,114 | B2 * | 4/2016 | Miklinski | H01R 13/6273 |
| 9,409,536 | B2 * | 8/2016 | Gunreben | H01R 13/6273 |
| 9,520,674 | B2 * | 12/2016 | Regnier | H01R 13/639 |
| 9,748,677 | B2 | 8/2017 | Jae | |
| 9,991,631 | B2 | 6/2018 | Foxconn | |
| 10,290,972 | B2 * | 5/2019 | Gunreben | H01R 13/629 |
| 2004/0192099 | A1 * | 9/2004 | Seminara | H01R 13/6273 439/352 |
| 2004/0248454 | A1 * | 12/2004 | Gunreben | H01R 13/639 439/352 |
| 2006/0084314 | A1 * | 4/2006 | Takizawa | H01R 13/73 439/352 |
| 2007/0254518 | A1 * | 11/2007 | Nealle | H01R 13/6277 439/352 |
| 2015/0056869 | A1 * | 2/2015 | Yoshida | H01R 12/75 439/694 |
| 2015/0093928 | A1 * | 4/2015 | Chen | H01R 13/6273 439/352 |
| 2016/0118745 | A1 * | 4/2016 | Droesbeke | G02B 6/3817 385/76 |

* cited by examiner

ELECTRICAL CONNECTOR ASSEMBLY

BACKGROUND OF THE INVENTION

1. Field of the Invention

The present invention relates generally to an electrical connector assembly, and particularly to the plug connector and the receptacle connector mateable with each other with corresponding metal locking mechanism.

2. Description of Related Arts

U.S. Pat. No. 9,991,631 discloses the mated plug connector and receptacle connector wherein the receptacle is equipped with a deflectable latch unitarily formed on the insulative receptacle housing and the plug connector is equipped with a stationary locking protrusion unitarily formed on the insulative plug housing and interengaged with the deflectable latch. Anyhow, such latch mechanism may tend to be worn out after repeated use.

It is desired to provide an electrical connector assembly with the endurable latch mechanism for long time use.

SUMMARY OF THE INVENTION

To achieve the above object, an electrical connector assembly includes a receptacle connector and a plug connector mateable with each other. The receptacle connector includes an insulative receptacle housing, a plurality of receptacle contacts retained in the receptacle housing, and a pair of metallic latches on two sides. The insulative receptacle housing includes a base and a pair of side arms extending forwardly from two opposite ends of the base along a front-to-back direction and spaced from each other in a transverse direction perpendicular to the front-to-back direction to commonly form a receiving space thereamong. The receptacle contacts extend into the receiving space. Each side arms forms a receiving groove communicating with the receiving space in the transverse direction. A pair of metallic latches are received within the corresponding receiving grooves, respectively, with the corresponding locking heads projecting into the receiving space in the transverse direction. The plug connector includes an insulative plug housing and a pair of immovable metal locking pieces thereon. The insulative plug housing includes a front face and a pair of side faces. The metal locking piece defines an L-shaped structure with a front section hidden behind and parallel to the front face, a rear section hidden behind and parallel to the side face, and a middle section with a locking protrusion for engagement with the locking head of the deflectable latch of the receptacle connector during mating.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
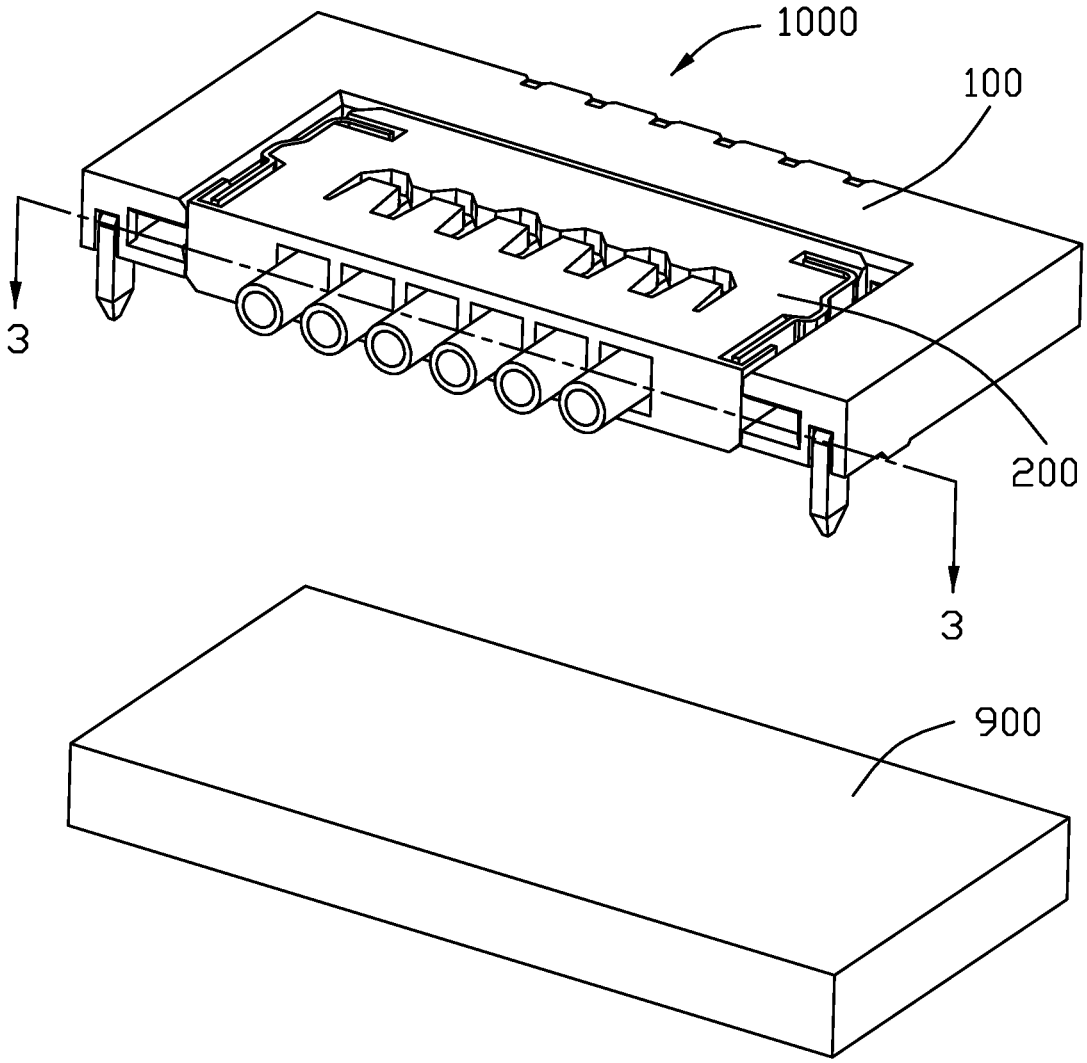
FIG. 1 is a perspective view of an electrical connector assembly according to the invention wherein the plug connector and the receptacle connector are mate with each other.
Figure 2:
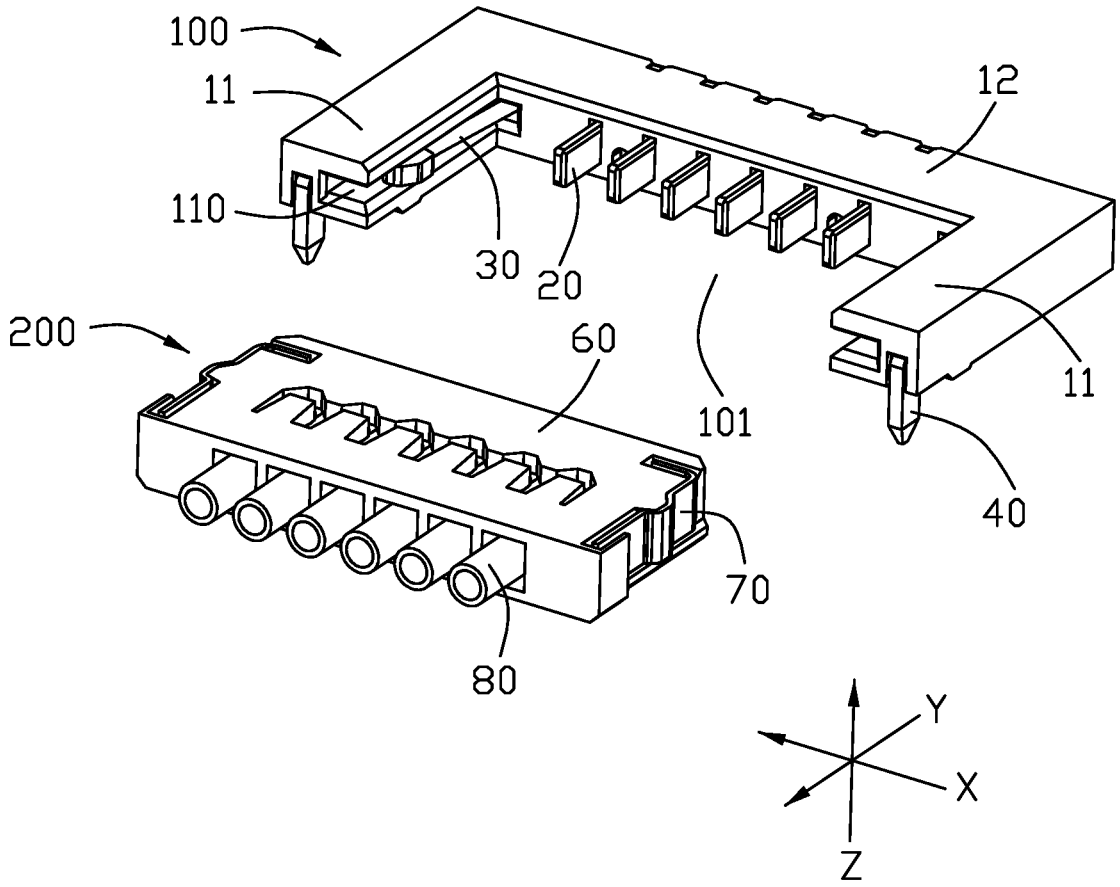
FIG. 2 is a perspective view of the electrical connector assembly of FIG. 1 wherein the plug connector and the receptacle connector are separated from each other.
Figure 3:
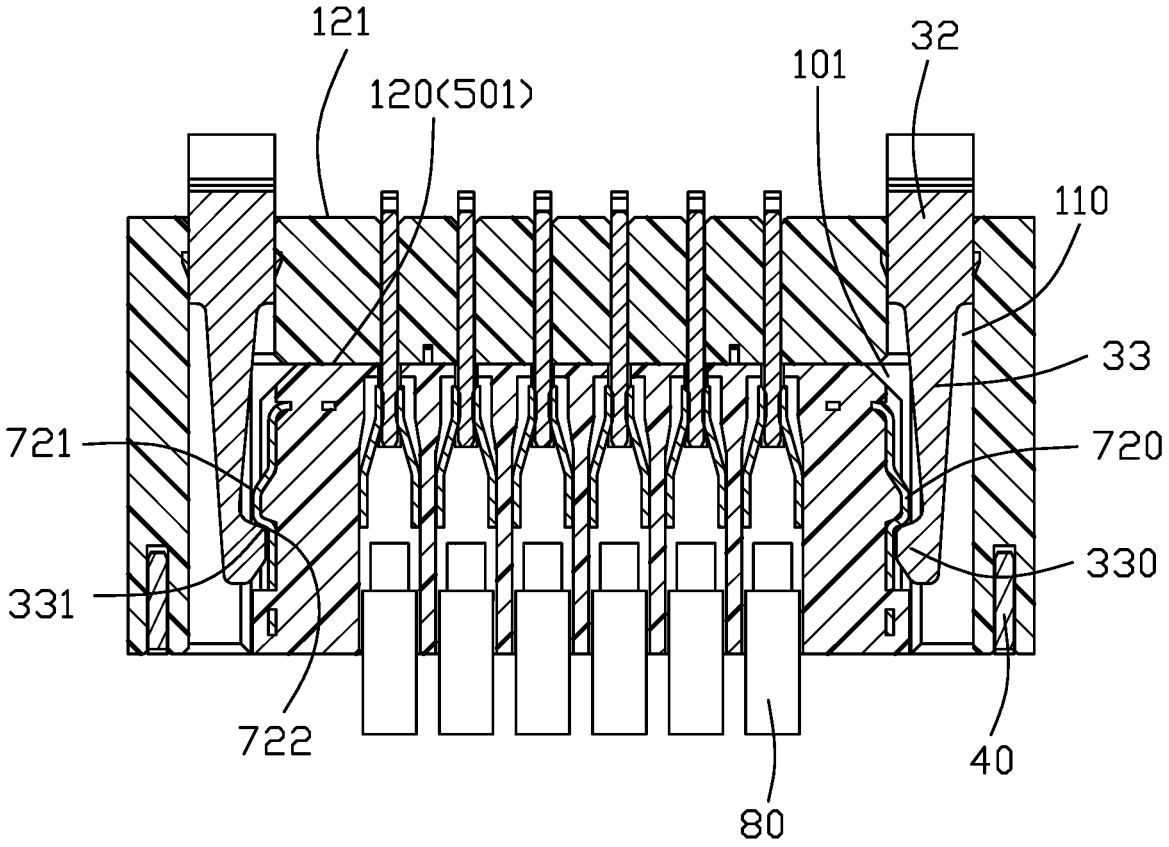
FIG. 3 is a cross-sectional view of the electrical connector assembly of FIG. 1 along line 3-3.
Figure 4:
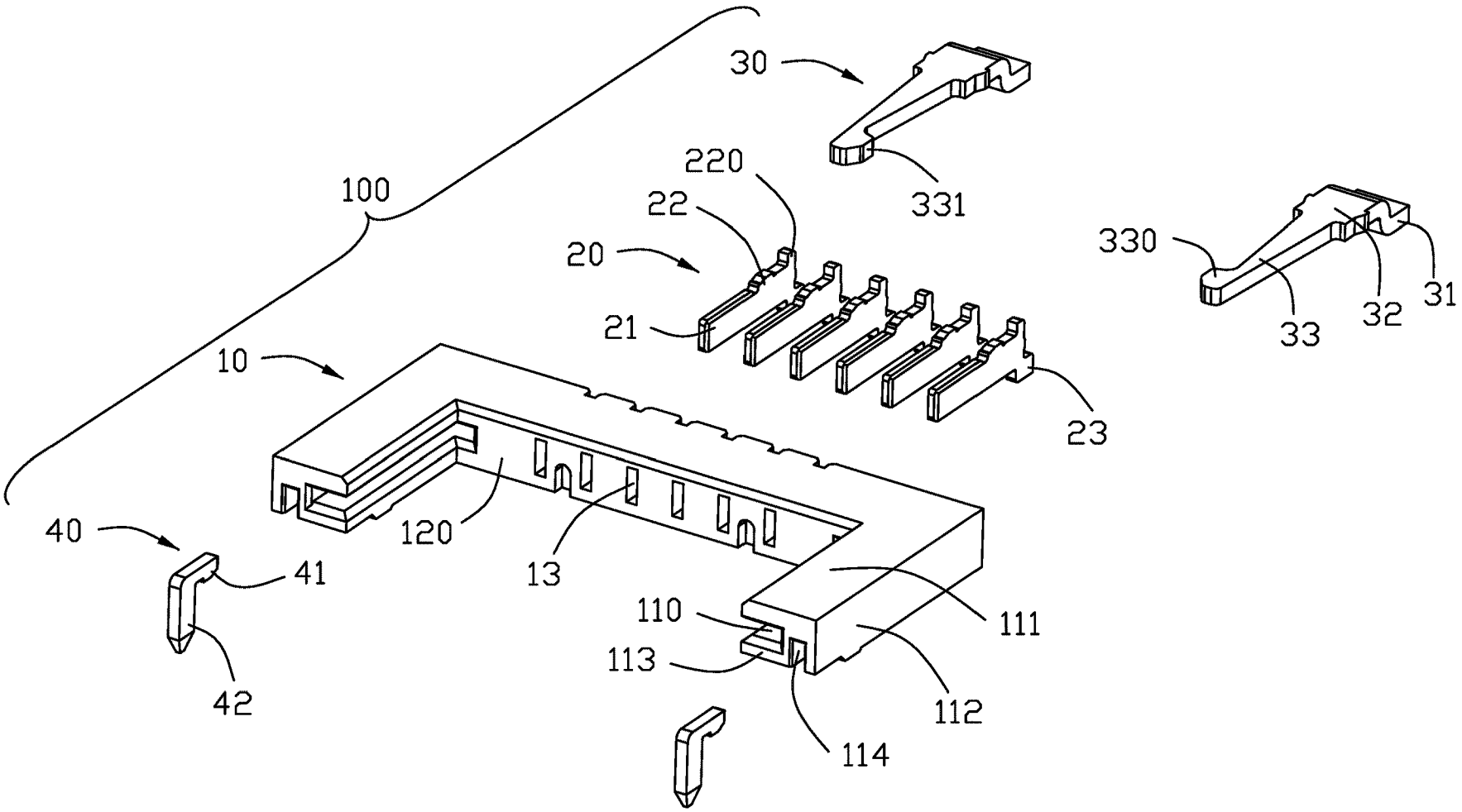
FIG. 4 is an exploded perspective view of the receptacle connector of FIG. 1.
Figure 5:
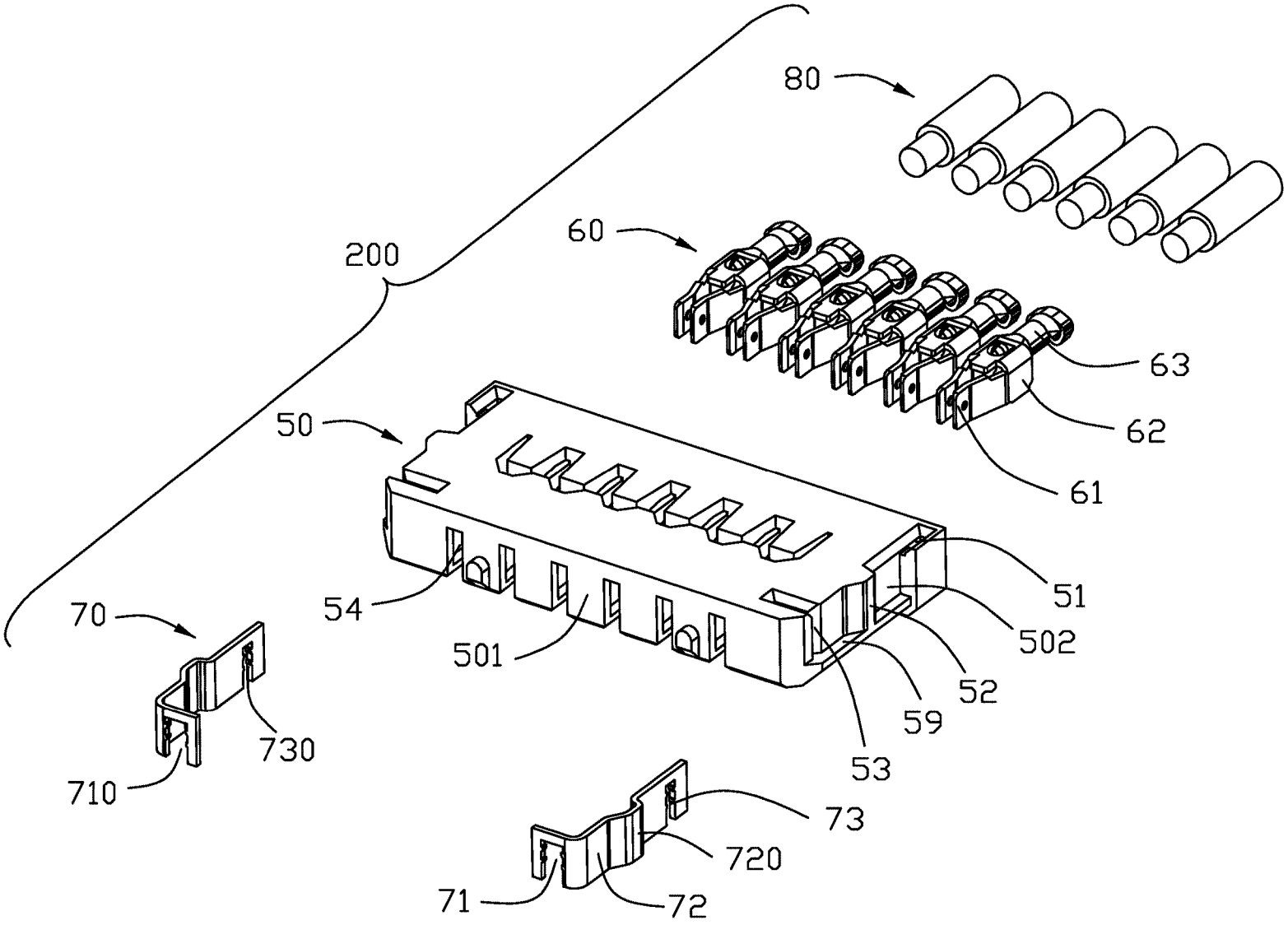
FIG. 5 is an exploded perspective view of the receptacle connector of FIG. 1.

An electrical connector assembly 1000 includes a receptacle connector 100 for mounting to the printed circuit board 900 and a plug connector 200, which is connected with a plurality of wires 80, mateable with each other in a front-to-back direction Y.

The receptacle connector 100 includes an insulative receptacle housing 10, a plurality of receptacle 20 contacts retained in the housing 10, and a pair of deflectable latches 30. The receptacle housing includes a base 12 extending along a transverse direction X perpendicular to the front-to-back direction Y, and a pair of side arms 11 extending forwardly from two opposite ends of the base 12 in the front-to-back direction and spaced from each other in the transverse direction X, The base 12 and the pair of side arms 11 commonly form receiving space 101 thereamong. The receiving space 101 is open to an exterior in the vertical direction Z and forwardly in the front-to-back direction. Each side arm 11 forms a receiving groove 110 transversely communicating with the receiving space 101 in the transverse direction. The deflectable latches 30 are received within the corresponding receiving grooves 110, respectively. The side arm 11 includes a top wall 111, a bottom wall 113 and a side wall 112 to surround the corresponding receiving groove 110. The receiving groove 110 extends through the side arm 11 in the front-to-back direction and also through the rear face 121 of the base 12 so as to allow the corresponding latch 30 to be inserted thereinto for assembling the latch 30 therein. Each side arm 11 further forms a retention slot 114 to receive a securing part 40. The securing part 40 includes a horizontal section 41 retained in the retention slot 114, and a vertical section 42 extending downwardly out of the receptacle housing 10. The base 12 forms a plurality of passageways 13 extending through the front face 120 and the rear face 121 of the base 12.

The receptacle contacts 20 are forwardly assembled into the corresponding passageways 13, respectively, from the rear face 121. Each receptacle contact 20 includes a retaining section 22 retained in the passageway 13, a contacting section 21 extending forwardly from the retaining section 21 and into the receiving space 101, and a soldering section 23 extending rearwardly from the retaining section 22 out of the receptacle housing 10 for mounting to the printed circuit board 900. The retaining section 22 forms barbs for retention consideration, and a shoulder 220 to abut against the base 12.

The latch 30 includes a retaining portion 32 equipped with barbs and retained in the base 12, and a deflectable arm 33 received within the corresponding receiving groove 110 and deflectable in the transverse direction. The deflectable arm 33 is equipped with a locking head 330 having a locking face 331 thereon. The thickness direction of the deflectable latch 30 is the vertical direction Z. The deflectable latch 30 further includes a soldering portion 31 outside of the receptacle housing 10 for mounting to the printed circuit board 900.

The plug connector 200 includes an insulative plug housing 50, a plurality of plug contacts 60 retained in the plug housing 50, and a pair of stationary L-shaped locking pieces 70.

The plug housing 50 includes a front face 501 and a rear face (not labeled) opposite to each other in the front-to-back direction, and a pair of side faces 502 opposite to each other in the transverse direction. Each side of the plug housing 50 forms a first retention groove 51 around a rear side, a second retention groove 52 around the front face 501, and a protrusion 52 therebetween in the front-to-back direction Y. The first retention groove 51 extends along the front-to-back direction Y while the second retention groove extends along the transverse direction X. Both the first retention groove 51 and the second retention groove 52 extends through a top face of the plug housing 50 so as to allow the locking piece 70 to be downwardly assembled thereinto. The locking piece 70 includes a front section 71 retained in the second retention groove 52, a rear section 73 retained in the first retention groove 51, and a middle section 72 therebetween in the front-to-back direction Y. The middle section 72 includes a locking protrusion 720 with a front guiding face 721 and a rear locking face 722. The locking protrusion 720 compliantly covers the protrusion 52. The front section 71 has a front notch 710, and the rear section 73 has a rear notch 730. For enhancing retention, the front section 71 includes the barbs facing the front notch 710, and the rear section 73 includes the barbs facing the rear notch 730. To protect the locking piece 70, the side face 502 forms step 59 under the locking piece 70. Notably, different from the receptacle connector 100 wherein the thickness direction of the latch 30 is the vertical direction Z, the thickness direction of the locking piece 70 is perpendicular to the vertical direction Z. It is because the locking piece 70 is immovably supported by the plug housing 50 while the latch 30 is deflectable. It is also the reason that the thickness of the latch 30 is larger than that of the locking piece 70.

During mating, the plug housing 50 is received within the receiving space 101, the front face 501 confronts the front face 120, and the latch 30 engages the locking piece 70, wherein the locking face 722 engages the locking head 330.

The plug housing 50 forms the mating slots 54 extending through the front face 501 and the bottom face. The plug contact 60 includes the contacting section 61 received within the mating slot 54 and equipped with a pair of arms 611 to sandwich the contacting section 21 of the receptacle contact 20 which extends into the mating slot 54 during mating. The plug contact 60 further includes the retaining section 62 behind the contacting section 61 for retaining within the plug housing 50, and a connecting section 63 behind the retaining section 62 for connecting to the corresponding wires 80.

Notably, in the invention, the locking engagement between the locking head of the deflectable latch of the receptacle connector and the immovable locking protrusion of the plug connector is operated with metal-to-metal, thus resisting wearing.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a receptacle connector and a plug connector mateable with each other at least in a front-to-back direction, the receptacle connector for mounting to a printed circuit board, including:

an insulative receptacle housing having a base extending along a transverse direction perpendicular to the front-to-back direction, and a pair of side arms extending forwardly from two opposite ends of the base in the front-to-back direction and spaced from each other in said transverse direction, a receiving space formed among the base and the pair of side arms;

a plurality of receptacle contacts retained in the base of the receptacle housing;

a pair of deflectable metal latches retained to the corresponding side arms with corresponding locking heads extending into the receiving space in the transverse direction;

the plug connector including:

an insulative plug housing with a front face and two opposite side faces;

a plurality of plug contacts retained in the plug housing;

a pair of immovable metal locking pieces located around upon the two opposite side faces of the plug housing, each locking piece forming a locking protrusion with opposite guiding face and locking face in said front-to-back direction; wherein during mated, the plug housing is received within the receiving space with the front face of the plug housing confronting the base of the receptacle housing, and the locking faces of the locking pieces of the plug connector engage the locking heads of the corresponding latches of the receptacle connector in a metal-to-metal relation.

2. The electrical connector assembly as claimed in claim 1, wherein in the receptacle connector, the side arms forms a receiving groove to receive the corresponding latch, and said receiving groove extends through a rear face of the base to allow the corresponding latch to be assembled forwardly thereinto in said front-to-back direction.

3. The electrical connector assembly as claimed in claim 2, wherein a thickness direction of the latch is a vertical direction perpendicular to both the front-to-back direction and the transverse direction.

4. The electrical connector assembly as claimed in claim 3, wherein the latch further includes a horizontal soldering section for mounting to the printed circuit board.

5. The electrical connector assembly as claimed in claim 1, wherein in the plug connector, the plug housing form a first retention groove a second retention groove to respectively receive a rear section and a front section of the corresponding locking piece, said locking protrusion being located between the front section and the rear section in the front-to-back direction.

6. The electrical connector assembly as claimed in claim 5, wherein both the first retention groove and the second retention groove extend through a top face of the plug housing to allow the metal locking piece to be assembled thereinto in a vertical direction perpendicular to both the front-to-back direction and the transverse direction.

7. The electrical connector assembly as claimed in claim 5, wherein each locking piece defines an L-shaped structure with the front section extending in the transverse direction and the rear section extending in the front-to-back direction.

8. The electrical connector assembly as claimed in claim 1, wherein the plug housing forms a step on each side face under the corresponding locking piece in a vertical direction perpendicular to both the front-to-back direction and the transverse direction for protection the locking piece.

9. The electrical connector assembly as claimed in claim 1, wherein a thickness direction of the locking piece is perpendicular to a vertical direction perpendicular to both the front-to-back direction and the transverse direction.

10. The electrical connector assembly as claimed in claim 1, wherein a thickness of the latch is larger than that of the locking piece.

11. A receptacle connector for mounting to a printed circuit board and mating with a plug connector having a pair of immoveable locking protrusions on two sides thereof, comprising:

an insulative receptacle housing having a base extending along a transverse direction perpendicular to the front-to-back direction, and a pair of side arms extending forwardly from two opposite ends of the base in the front-to-back direction and spaced from each other in said transverse direction, a receiving space formed among the base and the pair of side arms for receiving the plug connector therein;

a plurality of receptacle contacts retained in the base of the receptacle housing; and a pair of deflectable metal latches retained to the corresponding side arms with corresponding locking heads extending into the receiving space in the transverse direction for engagement with the locking protrusions in the front-to-back direction during mating.

12. The receptacle connector as claimed in claim 11, wherein each side arm forms a receiving groove to receive the corresponding latch therein, and said receiving groove extends through a rear face of the receptacle housing to all the latch to be forwardly assembled thereinto in the front-to-back direction.

13. The receptacle connector as claimed in claim 12, wherein a thickness direction of the latch is a vertical direction perpendicular to both the front-to-back direction and the transverse direction.

14. The receptacle connector as claimed in claim 13, wherein each latch includes rear retaining portion and a latch arm extending forwardly from the retaining portion with the corresponding locking head at a front free end.

15. The receptacle connector as claimed in claim 14, wherein each latch further includes a soldering section exposed outside of the receptacle housing for mounting to the printed circuit board.

16. A plug connector for mating with a receptacle connector defining a receiving space with a pair of deflectable metal latches located by two sides of the receiving space and equipped with respective locking heads, comprising:

an insulative plug housing forming opposite front face and rear face in a front-to-back direction, and two opposite side faces in a transverse direction perpendicular to the front-to-back direction;

a pair of protrusions formed on the side faces, respectively;

a plurality of plug contacts retained in the plug housing; and a pair of immovable metal locking pieces located around upon the two opposite side faces of the plug housing, each locking piece forming a locking protrusion compliantly covering the corresponding protrusion in a supported manner, wherein each locking protrusion forms opposite guiding face and locking face in said front-to-back direction, the locking faces of the locking pieces of the plug connector engaging the locking heads of the latches of the receptacle connector.

17. The plug connector as claimed in claim 16, wherein each locking piece forms an L-shaped configuration with a front section extending in the transverse direction, and a rear section extending in the front-to-back direction, and a middle section therebetween where the locking protrusion is located.

18. The plug connector as claimed in claim 17, wherein the plug housing forms a first retention groove to receive the front section of the locking piece, and a second retention groove to receive the rear section of the locking piece.

19. The plug connector as claimed in claim 18, wherein both the first retention groove and the second retention groove extend through a top face of the plug housing to allow the locking piece to be assembled thereinto in a vertical direction perpendicular to both the front-to-back direction and the transverse direction.

20. The plug connector as claimed in claim 15, wherein the plug housing further forms a step on each side face under the corresponding locking piece in a vertical direction perpendicular to both the front-to-back direction and the transverse direction for protecting the corresponding locking piece.

* * * * *